US006018826A

United States Patent [19]

Yang

[11] Patent Number: 6,018,826

[45] Date of Patent: Feb. 1, 2000

[54] COLLAPSIBLE INFANT BATHTUB

[76] Inventor: Peng-Yao Yang, No. 561, Sec. 4, An Ho Road, Tainan, Taiwan

[21] Appl. No.: 09/329,197

[22] Filed: Jun. 10, 1999

[51] Int. Cl.[7] ..... A47K 3/064

[52] U.S. Cl. ..... 4/572.1; 4/574.1; 4/575.1; 4/621

[58] Field of Search ..... 4/553, 554, 547, 4/571.1, 572.1, 573.1, 574.1, 575.1, 578.1, 579, 584, 585, 586, 589, 590, 595, 621, 659

[56] References Cited

U.S. PATENT DOCUMENTS 5,425,149 6/1995 Crossley et al. ..... 4/572.1
5,588,159 12/1996 Poulson et al. ..... 4/572.1

*Primary Examiner*—Henry J. Recla
*Assistant Examiner*—Tuan Nguyen
*Attorney, Agent, or Firm*—Rosenberg, Klein & Lee

[57] ABSTRACT

A collapsible infant bathtub in the present invention is made of a base, a headrest, a footrest and pressing devices. On each end of the headrest and footrest is respectively provided with a slider to receive each head end and foot end of the base. When being pulled outward along each skirt of the base, each slider will touch the slant surface of the button of each pressing device to force each button to shrink inside for each slider to pass on, and then each button will protrude outward the hole of each slider and stop each slider so as to prevent the headrest and footrest from being wholly pulled outward. On the bottom of each slider is provided with a catching member so as to stop against each stopping block of the base to firmly secure the headrest and footrest. After each button being pressed to shrink inward, each slider can be pushed inward along each skirt of the base to a secured position so as to collapse the infant bathtub for storage or carriage.

1 Claim, 5 Drawing Sheets

COLLAPSIBLE INFANT BATHTUB

BACKGROUND OF THE INVENTION

1. Field of the Invention

The present invention relates to a collapsible infant bathtub with innovatory practical features, and more particularly to an infant bathtub with a headrest and a footrest which can be collapsed after use so as to be convenient for storage or carriage.

2. Description of the Related Art

Referring to FIG. 1, a conventional infant bathtub 10 on the market for conveniently bathing an infant is molded as an integrality. The infant bathtub 10 is provided with a headrest 101, a bathing reservoir 102, a surrounding rim 103, a footrest 104 and a support 105. While bathing an infant, place the infant in the bathing reservoir 102 and let the head and feet of the infant respectively be placed on the headrest 101 and the footrest 104. After finishing bathing the infant, the conventional infant bathtub 10 is place in a corner of a bathroom.

However, the conventional infant bathtub is relatively large so that it is inconvenient to be stored or carried.

SUMMARY OF THE INVENTION

Accordingly, the present invention is directed to a collapsible infant bathtub that substantially obviates the drawbacks of the prior art.

An object of the present invention is to provide an infant bathtub whose headrest and footrest can be collapsed so that the effective volume of the collapsed bathtub is convenient for storage and carriage.

Another object of the present invention is to provide a collapsible infant bathtub which is provided with pressing devices to securely stop both the headrest and footrest from accidentally being wholly pulled outside in the extended position or to release the headrest and footrest in the collapsed position.

Yet another object of the present invention is to provide a collapsible infant bathtub which is easily combined and yet can provide long and dependable service.

To achieve these advantages and in accordance with the purposes, a collapsible infant bathtub in the present invention is made of a base having the major bathing reservoir in it, a headrest, a footrest and pressing devices. On each end of the headrest and footrest is respectively provided with a slider to receive each head end and foot end of the base. When being pulled outward along each skirt of the base, each slider will touch the slant surface of the button of each pressing device to force each button to shrink inside for each slider to pass on, and then each button will protrude outward the hole of each slider and stop each slider so as to prevent the headrest and footrest from being wholly pulled outward.

Besides, on the bottom of each slider is provided with a catching member so as to stop against each stopping block of the base to firmly secure the headrest and footrest. After each button being pressed by a user to shrink inward, each slider can be pushed inward along each skirt of the base to a secured position so as to collapse the infant bathtub for storage or carriage.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Reference will now be made in detail to the preferred embodiments of the present invention, examples of which are illustrated in the accompanying drawings.

Figure 1:
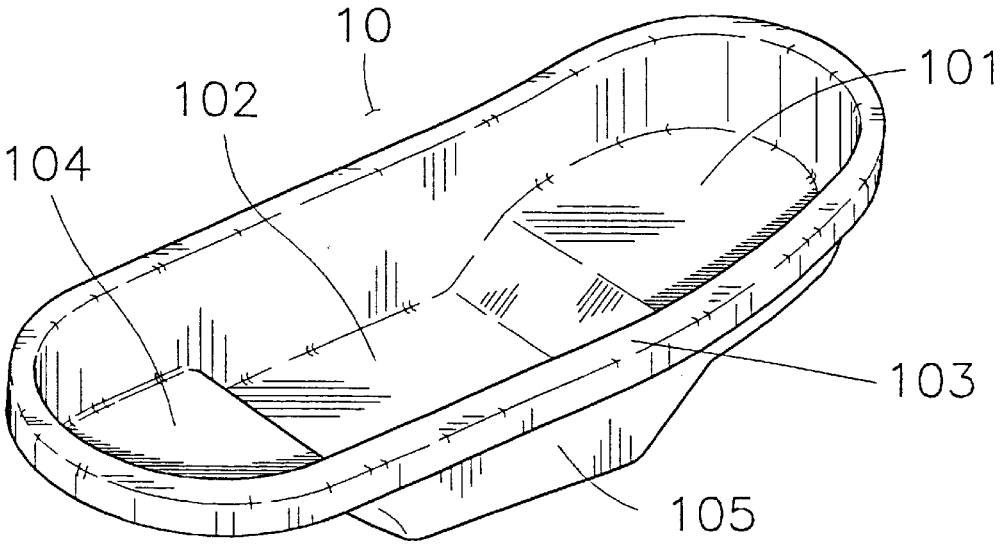
FIG. 1 (PRIOR ART)
FIG. 1 is a perspective view of a conventional infant bathtub.
Figure 3:
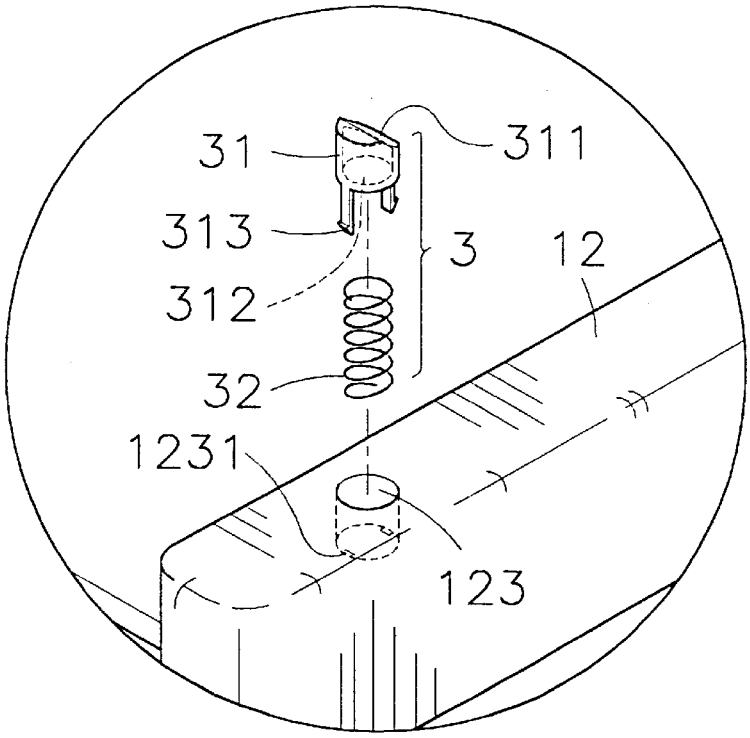
FIG. 3 is an exploded view of a preferred pressing device in accordance with the present invention.
Figure 2:
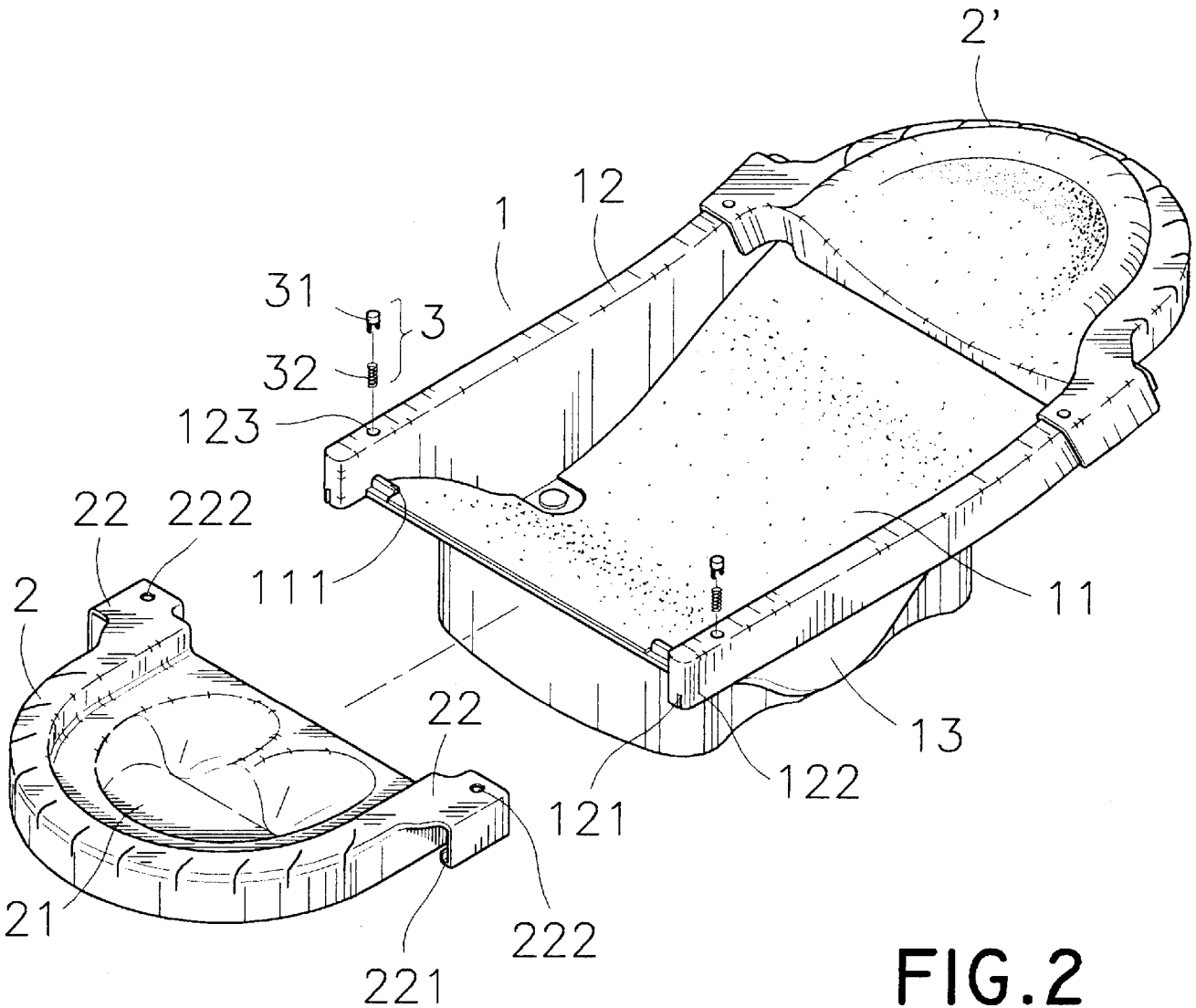
FIG. 2 is a perspective exploded view of a preferred embodiment of a collapsible infant bathtub in accordance with the present invention.

Referring to FIGS. 2 and 3, a preferred embodiment of a collapsible infant bathtub in the present invention is made of a base 1, a footrest 2, a headrest 2' and pressing devices 3.

The base 1 has a bathing reservoir 11 in it, and respectively at each foot end and head end of the bathing reservoir 11 adjacent to the footrest 2 and the headrest 2' is provided with a stopping block 111. The base 1 has two skirts 12 on both sides, and in the bottom of each skirt 12 is provided with a sliding groove 121. Each outer vertical side accordingly forms a stopping board 122. Near the foot end and the head end of each skirt 12 are respectively provided with a hole 123, and in the bottom of each hole 123 are provided several slots 1231. A support 13 is provided on the bottom of the base 1.

The footrest 2 and the headrest 2' are provided respectively connected to the foot and head ends of the base 1. The footrest 2 has a hollow 21 provided for placing bathing articles. On each end of the footrest 2 and the headrest 2' is provided with a slider 22. Each slider 22 is provided with a downward hook 221, and a hole 222 is provided in the upper surface of each slider 22. On the bottom of each slider 22 is provided with a catching member 223 to stop against each stopping block 111 on the bathing reservoir 11 so as to prevent the footrest 2 and the headrest 2' from being wholly pulled out.

The pressing devices 3 are respectively provided in the holes 123 of the skirts 12 of the base 1. Each pressing device 3 has a button 31 and a spring 32. The button 31 is provided with a slant surface 311 at the top end and a central hollow 312 for the spring 32 to be inserted into. At the bottom end of the button 31 are provided with several barbs 313.

Figure 4:
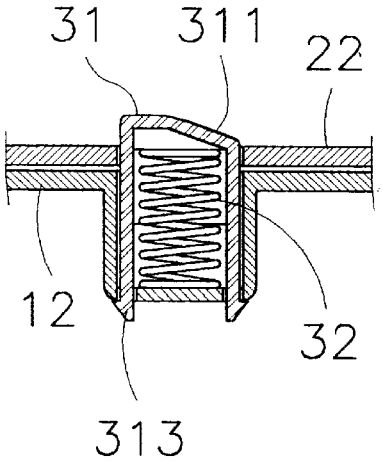
FIG. 4 is a sectional view of a preferred pressing device in an assembled configuration in accordance with the present invention.
Figure 5:
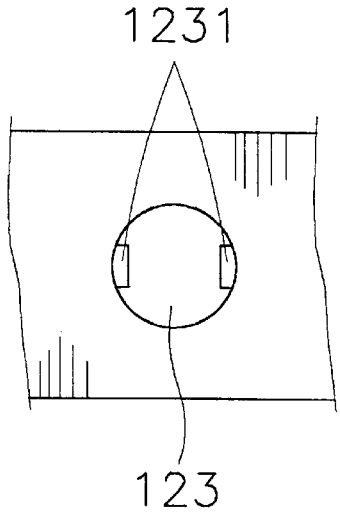
FIG. 5 is a schematic bottom view of a preferred hole of the base in accordance with the present invention.
Figure 6:
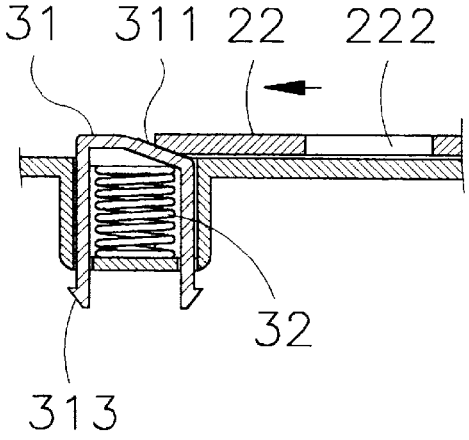
FIG. 6 is a sectional view showing a slider touching the slant surface of a button to force the button to shrink inward in accordance with the present invention.

While being assembled, as shown in FIGS. 4, 5 and 6, first, the spring 32 is inserted into the central hollow 312 of the button 31. By means of the barbs 313 of the button 31 being caught in the slots 1231 of the holes 123 of the skirt 12, the pressing device 3 will not fall from the hole 123 of the skirt 12. In this condition, the button 31 protrudes outward the hole 123 of the skirt 12. Then, the end of the skirt 12 of the base 1 is sleeved in the slider 22 with the hook 221 being inserted in the sliding groove 121 and with the inner surface of the hook 221 contacting the stopping board 122 of the skirt 12. At last, the button 31 is pressed to shrink inward, and the slider 22 is pushed to pass on to make the button 31 protrude outward the hole 222 of the slider 22 so as to secure the slider 22.

Figure 7:
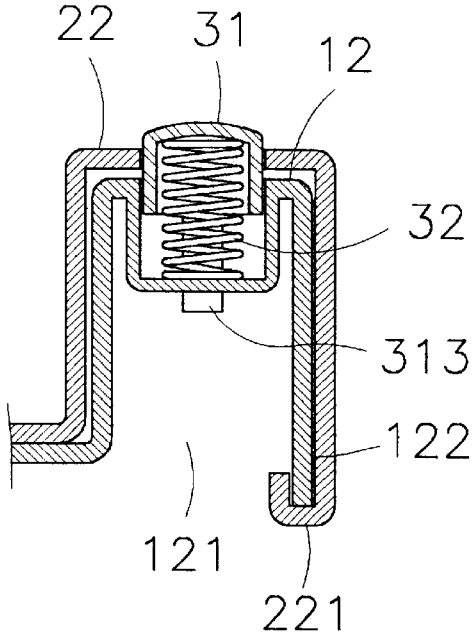
FIG. 7 is a sectional view showing a button protruding outward the hole of a slider in accordance with the present invention.
Figure 8:
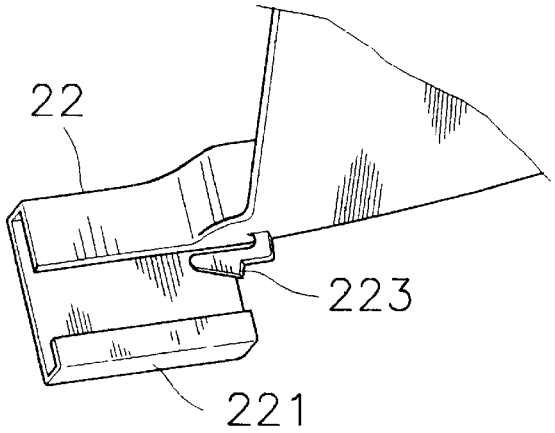
FIG. 8 is a perspective view of the catching member provided on the bottom of a slider in accordance with the present invention.
Figure 9:
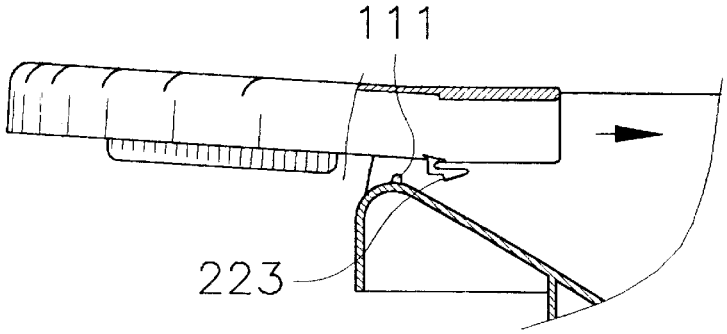
FIG. 9 is a schematic view showing a slider being pushed inward to collapse an infant bathtub in accordance with the present invention.
Figure 10A:
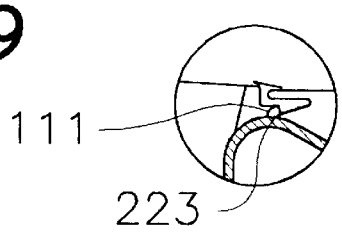
FIG. 10 is a schematic view showing the catching member of a slider stopping against the stopping block of the base in accordance with the present invention.
Figure 10:
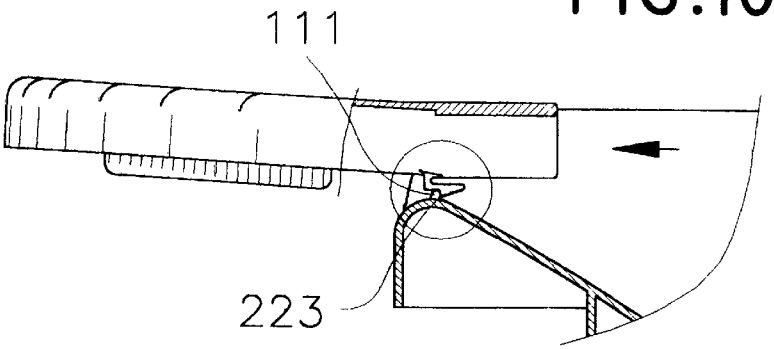

While the footrest 2 and the headrest 2' being extended, referring to FIGS. 6 and 7, each slider 22 is pushed outward along the skirt 12 to touch the slant surface 311 of each button 31 to force each button 31 to shrink inside for each slider 22 to pass on, and then the button 31 will protrude outward the hole 222 of each slider 22 and stop each slider 22 so as to prevent the footrest 2 and the headrest 2' from being wholly pulled outward. Even if each slider 22 is pulled too powerfully for each button 31 to stop, the footrest 2 and the headrest 2' will not wholly fall outside because the catching member 223 protruding on the bottom of each slider 22 will stop the stopping block 111 on the bathing reservoir 11 of the base 1, as shown in FIGS. 8, 9 and 10. Therefore, the footrest 2 and the headrest 2' will be more firmly secured.

Figure 11:
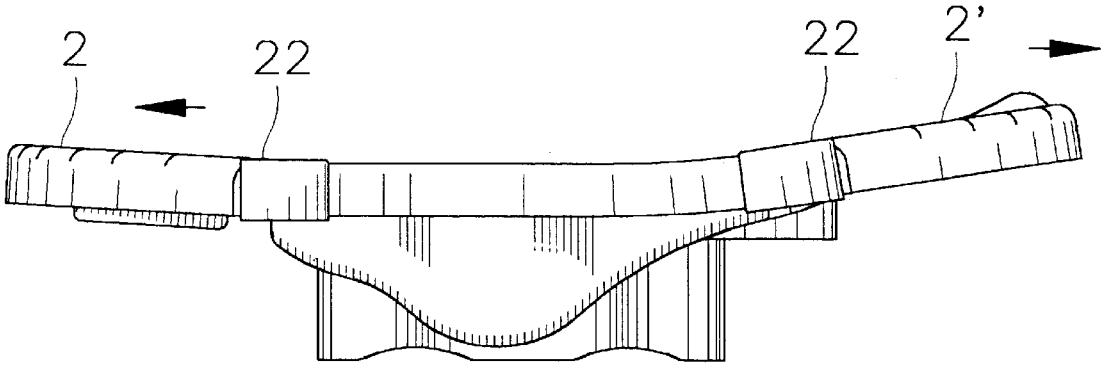
FIG. 11 is a preferred embodiment of an infant bathtub in the extended position in accordance with the present invention.
Figure 12:
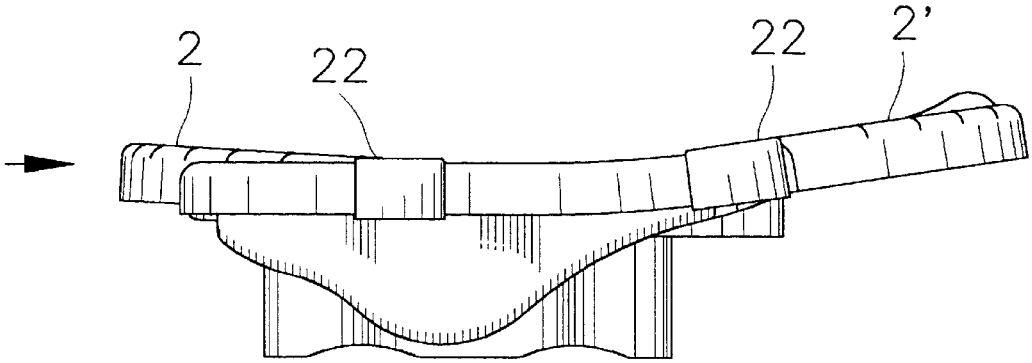
FIG. 12 is a preferred embodiment of an infant bathtub with the footrest being collapsed in accordance with the present invention; and, FIG. 13 is a preferred embodiment of an infant bathtub in the collapsed position in accordance with the present invention.
Figure 13:
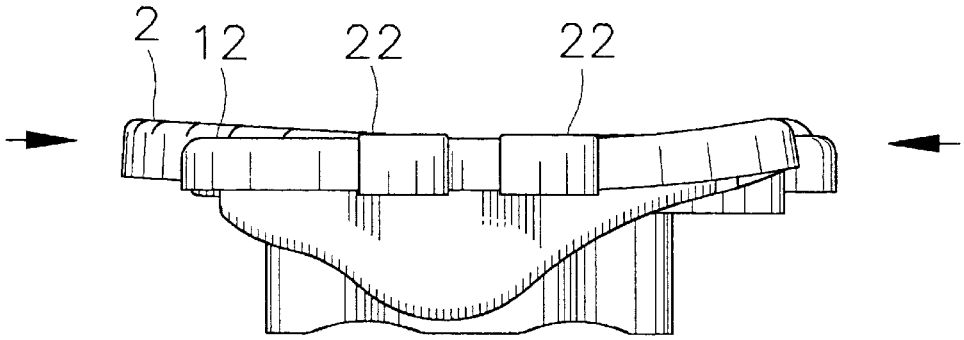

While the footrest 2 and the headrest 2' being collapsed, referring to FIGS. 11, 12 and 13, each button 31 is pressed to shrink inside, and then each slider 22 is pushed inward along the skirt 12 to a secured position so as to make the footrest 2 and the headrest 2' be collapsed for storage or carriage.

While the preferred embodiments of the invention have been described above, it will be recognized and understood that various modifications may be made therein and the appended claims are intended to cover all such modifications which may fall within the spirit and scope of the invention.

What is claimed is:

1. A collapsible infant bathtub comprising:

a base having a foot end and an opposite head end, a bathing reservoir therebetween, said foot end and said head end of said bathing reservoir being provided with a stopping block, said base having a skirt on each side, each of said skirts being provided with a sliding groove extending the length thereof, each of said skirts accordingly forming a stopping board, the foot end and the head end of each of said skirts being respectively provided with a hole, the bottom of each of said holes being provided with several slots;

a footrest and a headrest, each having a slider on each side thereof with a downward extending hook slidably engaging respective grooves in said skirts, a hole being provided in the upper surface of each slider, each said slider being provided with a catching member to abut each said stopping block on said bathing reservoir so as to prevent said footrest and said headrest from being separated therefrom;

pressing devices being respectively provided in said holes of said skirts of said base, each of said pressing devices having a button and a spring, said button being provided with a slant surface at the top end thereof and a central hollow for said spring to be inserted there into, said button being provided with several barbs received in said slots, the end of each of said skirts of said base being slidably received in each of said sliders with said hook being respectively inserted in said sliding groove and with an inner surface of said hook respectively contacting said stopping board of each skirt, each of said buttons being pressed inward, each of said sliders being pushed inward along each of said skirts until each of said buttons protrude outward through said hole of each of said sliders so as to secure said footrest and said headrest to said base, and while said footrest and said headrest being collapsed, each of said buttons being pressed within each hole, each of said sliders being pushed inward along each said skirt to a secured position so as to collapse said footrest and said headrest for storage or carriage.

* * * * *